US008499900B1

(12) United States Patent
Heyden et al.

(10) Patent No.: US 8,499,900 B1
(45) Date of Patent: Aug. 6, 2013

(54) ELECTRO-HYDRAULIC RAILCAR RETARDERS FOR CONTROLLING THE SPEED OF A RAILCAR

(75) Inventors: Thomas J. Heyden, Arlington Heights, IL (US); Gregory P. Reitz, Silver Lake, WI (US); Kurt J. Penney, Lexington, SC (US)

(73) Assignee: AAA Sales & Engineering, Inc., Oak Creek, WI (US)

( * ) Notice: Subject to any disclaimer, the term of this patent is extended or adjusted under 35 U.S.C. 154(b) by 905 days.

(21) Appl. No.: 12/349,801

(22) Filed: Jan. 7, 2009

Related U.S. Application Data

(60) Provisional application No. 61/048,854, filed on Apr. 29, 2008.

(51) Int. Cl.
*B61K 7/02* (2006.01)

(52) U.S. Cl.
USPC ..... 188/62; 188/43; 246/182 A

(58) Field of Classification Search
USPC ..... 188/62, 153 R, 153 D, 153 A, 35, 188/41, 43; 104/26.2; 246/182 A, 182 BH; 267/221, 226, 291, 169; 74/99 R, 105
See application file for complete search history.

(56) References Cited

U.S. PATENT DOCUMENTS 2,014,551 A * 9/1935 Bone et al. ..... 188/62
3,200,245 A * 8/1965 Brown ..... 246/182 A
3,827,533 A * 8/1974 Noble ..... 188/62
4,393,960 A 7/1983 Mazur et al.
4,867,279 A * 9/1989 Link et al. ..... 188/62
4,967,511 A 11/1990 Werginz et al.
4,996,793 A 3/1991 Mazur
6,216,525 B1 4/2001 Bernd et al.
6,422,519 B1 7/2002 Braatz
7,140,698 B2 11/2006 Braatz et al.
7,306,077 B2 12/2007 Heyden et al.
7,325,567 B2 2/2008 Heyden et al.
7,392,887 B2 7/2008 Heyden et al.
2003/0107028 A1 * 6/2003 Martin ..... 254/200
2006/0225968 A1 * 10/2006 Heyden et al. ..... 188/62
2008/0237511 A1 10/2008 Heyden et al.

* cited by examiner

*Primary Examiner* — Anna Momper

(74) *Attorney, Agent, or Firm* — Andrus, Sceales, Starke & Sawall, LLP

(57) ABSTRACT

A retarder for controlling the speed of a railcar is provided. The retarder includes a brake and a brake actuator that includes a hydraulic piston-cylinder and a spring. One of the piston and the cylinder acts on the brake and the other of the piston and the cylinder acts on one end of the spring. The other end of the spring acts on the brake. In this arrangement, supplying pressurized hydraulic fluid to the piston-cylinder causes both the piston-cylinder and the spring to move the brake towards a closed position in which the brake will apply braking pressure on the wheel of the railcar. The spring resiliently biases the brake into the closed position to maintain a substantially constant braking pressure on the wheel of the railcar as it moves through the retarder.

6 Claims, 3 Drawing Sheets

ELECTRO-HYDRAULIC RAILCAR RETARDERS FOR CONTROLLING THE SPEED OF A RAILCAR

CROSS-REFERENCE TO RELATED APPLICATION

This application claims priority of U.S. Provisional Patent Application No. 61/048,854, filed Apr. 29, 2008, which application is incorporated herein by reference.

FIELD

This disclosure relates generally to retarders of the kind suitable for reducing the speed of a railcar riding along a set of rails. More particularly, this application relates to electro-hydraulic railcar retarders for controlling the speed of a railcar.

BACKGROUND

Retarders are commonly used in railway classification yards, wherein railcars are caused to accelerate down a raised profile or hump towards a particular destination. As the railcars accelerate down the hump, the retarder applies braking pressure on the wheels of the railcar to prevent accidents or derailment and yet to maintain a predetermined speed of travel of the railcar. Many different types of electro-hydraulic, air and mechanical retarders are known in the art, some examples of which are disclosed in U.S. Pat. Nos. 4,393,960 and 7,140,698, the disclosures of which are incorporated herein by reference.

Known air retarders are generally more robust and efficient than known electro-hydraulic retarders. However railyard operators that already employ electro-hydraulic retarders have found the prospect of changing over to air retarders to be cost-prohibitive, especially because of the significant capital investment necessary to install an air plant. Also, these operators do not want to lose the significant amount of capital investment already made in equipment associated with the electro-hydraulic retarders, for example the battery back-up necessary to power such retarders for a short period of time in the event of a power outage.

The applicant therefore recognizes that there is currently a significant need in the art for more efficient and effective electro-hydraulic retarders, retarder systems and methods of operating such retarder systems.

Current electro-hydraulic retarders contain multiple sets of levers and brake shoes. A hydraulic piston-cylinder pushes against the levers to close the brake shoes to a width that is narrower than the width of the railcar wheel. When the wheel enters the retarder, the retarder must be capable of allowing the brake shoes to spread apart to the width of the wheel and yet still maintain the desired pressure on the sides of the wheel. The retarder must also allow for quick application and removal of pressure on the sides of the wheel. However because hydraulic systems are generally incompressible, it is currently difficult to use hydraulics to power a set of brake shoes in such a way that the brake shoes will quickly conform to the various widths of railcar wheels.

SUMMARY

The present disclosure describes electro-hydraulic retarders that overcome many problems with prior art electro-hydraulic retarders while using the same power source already existing at most railyards that currently employ electro-hydraulic retarder systems.

The electro-hydraulic retarders described herein are designed to allow opposing brake shoes on the retarder to spread to the width of a wheel entering the retarder, and yet still maintain a desired braking pressure on the sides of the wheel. In one example, the retarder includes a brake and a brake actuator that has a piston-cylinder and a spring. One of either the piston and the cylinder acts on the brake and the other of the piston and the cylinder acts on one end of the spring. The other end of the spring acts on the brake. In the preferred arrangement, the spring is wrapped around the cylinder and connected thereto in series. In such an arrangement, supplying pressurized hydraulic fluid to the piston-cylinder causes both the piston-cylinder and the spring to move the brake towards a closed position in which the brake will apply a predetermined braking pressure on a wheel of the railcar. The spring resiliently biases the brake into the closed position to maintain a substantially constant braking pressure on the wheel of the railcar as it moves through the retarder.

BRIEF SUMMARY OF THE DRAWINGS

The best mode of the invention is described herein with reference to the following drawing figures.

DETAILED DESCRIPTION OF THE DRAWINGS

Figure 1:
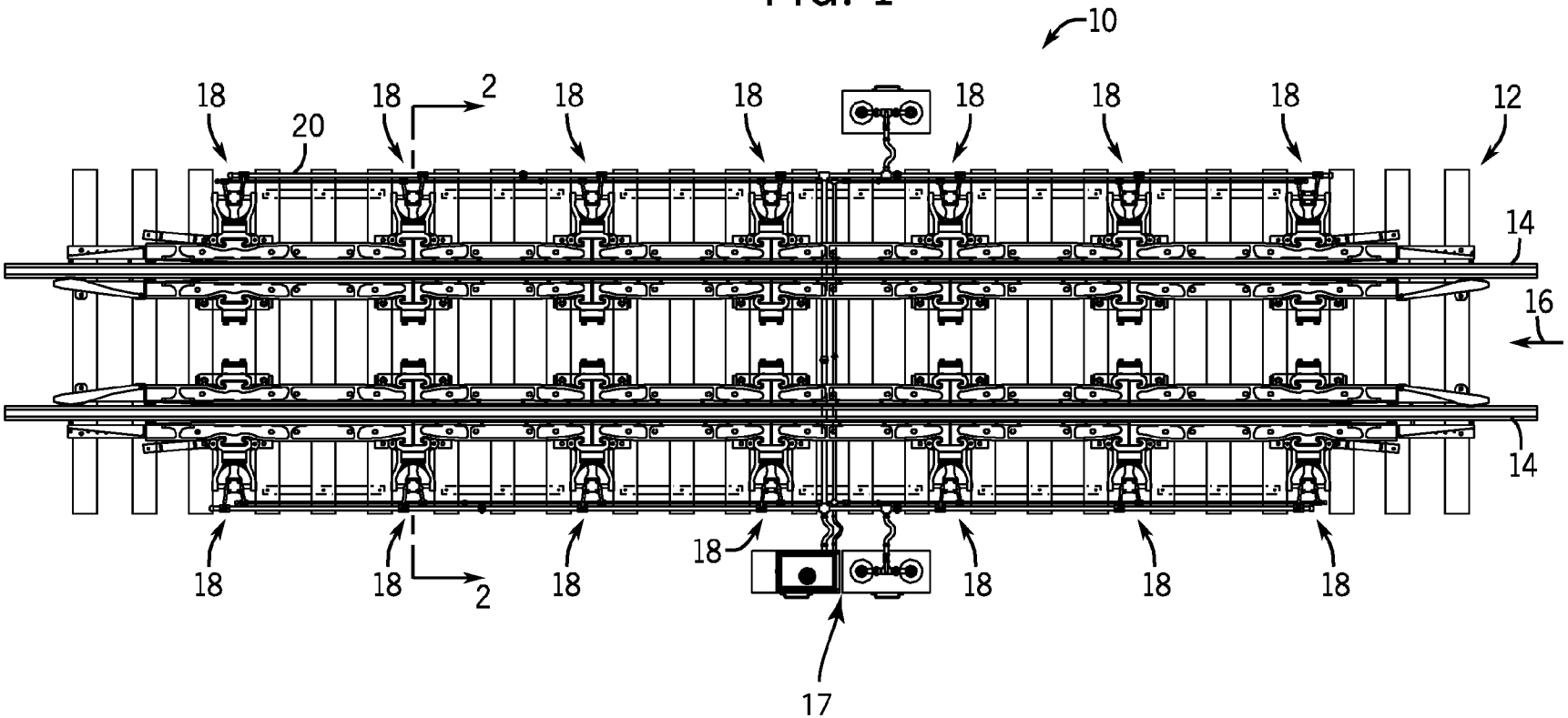
FIG. 1 is a top view of a retarder system.

FIG. 1 shows a railcar retarder system 10 that is mounted along a section of track 12 that includes a pair of conventional rails 14. It should be understood that the track 12 continues in both directions from the retarder system 10 with railcars entering the retarder from the right in the direction shown by arrow 16. The retarder system 10 includes a series of pairs of railcar retarders 18 positioned on opposite sides of each of the rails 14. As is conventional, the retarders 18 are positioned alongside and on top of the rails 14 such that, when actuated, the retarders 18 engage the sides of the railcar wheels to break or retard the moving railcar.

The retarder system 10 includes a series of seven pairs of retarders 18 that are connected in series to a hydraulic circuit 20. The hydraulic circuit 20 receives and relays pressurized hydraulic fluid to the retarders 18 to actuate the retarders 18 as further discussed below.

Figure 2:
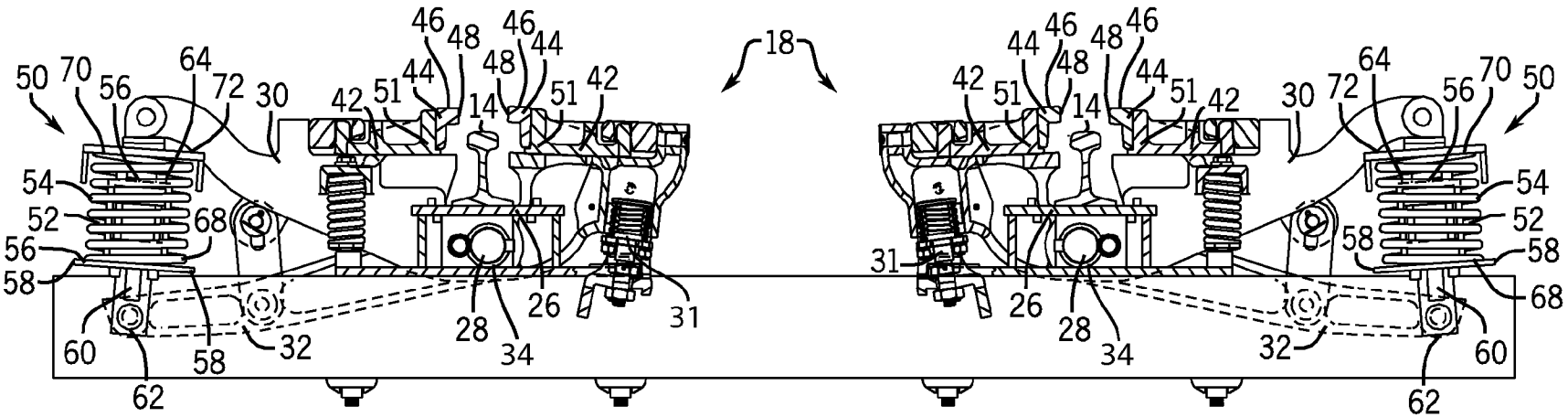
FIG. 2 is a view of one of the retarders in the retarder system taken along Section 2-2 in FIG. 1.
Figure 3:
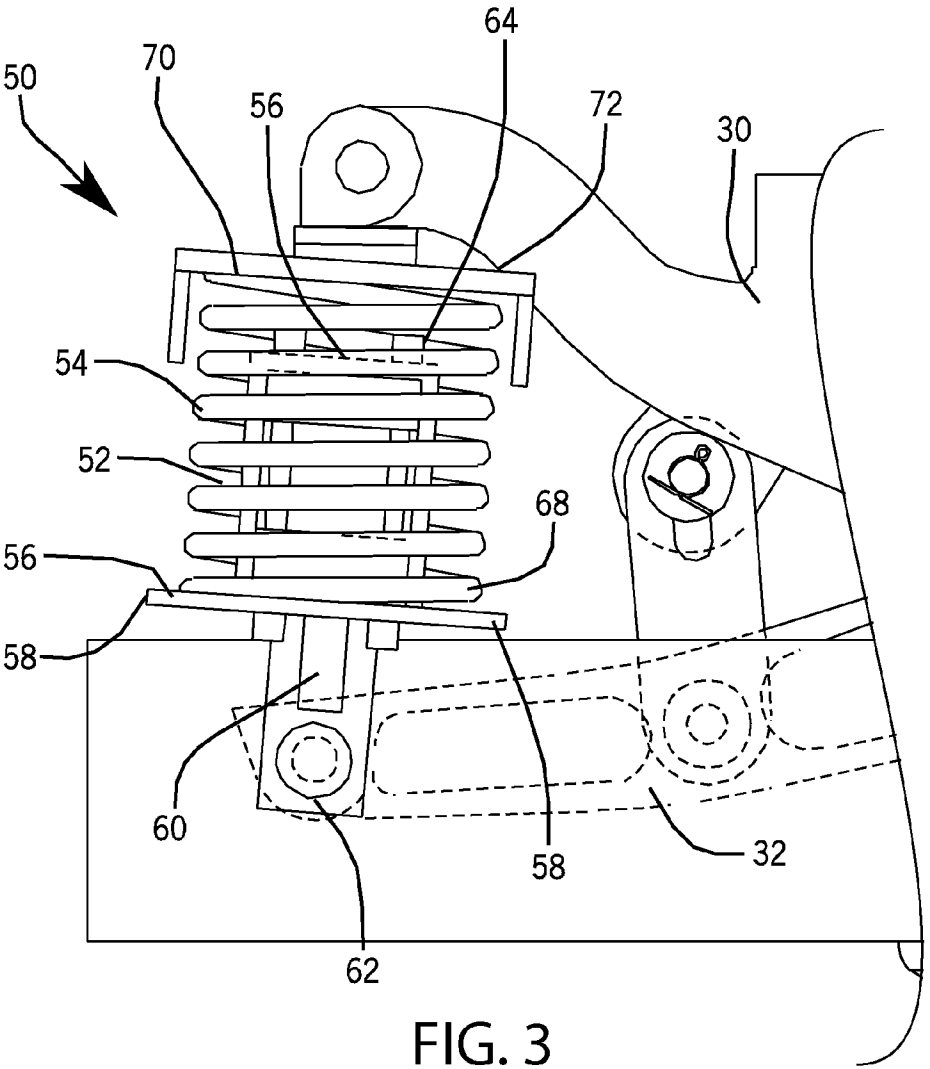
FIG. 3 is a close-up view of a brake actuator mounted between upper and lower levers of one of the retarders.

FIG. 2 shows a view taken along Section 2-2 in FIG. 1 through one pair of retarders 18 in the system 10. This view is representative of each retarder 18 in the system 10. Each retarder 18 includes rail supports 26 to which rail 14 is secured. Each rail support 26 contains a fulcrum pin 28 supporting upper and lower levers 30, 32. A pin 34 passes through an end of upper lever 30 and through a center portion of lower lever 32.

A brake beam 42 is mounted on each of the upper lever 30 and lower lever 32. Brake beams 42 are bolted to levers 30 and 32. The position of the brake beam 42 on the levers 30, 32 may be adjusted by an adjustment mechanism extending through flanges on the lever arms, according to known arrangements such as those described in U.S. Pat. No. 4,393,960.

Brake shoes 44 are mounted on the brake beams 42. The brake shoes 44 are usually L-shaped in cross section having a short arm 46 containing braking surface 48 supported by flange 51 mounted to brake beam 42.

A brake actuator 50 is mounted between the upper and lower levers 30, 32 and operates to pivot the upper and lower levers 30, 32 away from each other and thus move the brake shoes 44 closer together. The brake actuator 50 includes a piston-cylinder 52 that is overlapped by a spring 54. The piston-cylinder 52 is mounted inside a bracket 56 having outwardly extending flanges 58. The rod 60 is coupled to and acts upon a clevis connection 62 on the lower lever 32. The cylinder 64 resides in the bracket 56 and acts on the bottom face of the bracket 56. The spring 54 is wrapped around the bracket 56 so that the lower end 68 of the spring 54 rests on and therefore acts upon the outwardly extending flanges 58. The upper end 70 of the spring 54 acts upon a second bracket 72 which is connected to the upper lever 30.

In operation, when it is desired to retard the motion of a railcar riding on the rails 14, a supply of pressurized hydraulic fluid is provided by a pump 17 to the piston-cylinder 52, which causes the piston rod 60 to extend. The rod 60 pushes on the lower lever 32 and the cylinder 64 pushes on the bracket 56. The pressure from the piston-cylinder 52 is transferred to the flanges 58 which in turn push upwardly on the lower end 68 of the spring 54. The upper end 70 of the spring 54 is thereby forced against the bracket 72, and thus the upper lever 30. As such, the supply of pressurized hydraulic fluid causes the piston-cylinder 52 and spring 54 to together force the levers 30, 32 to pivot apart about the axis 28. In turn, this causes the brake shoes 44 to move closer together and into a closed position wherein braking pressure is applied to either side of a railcar wheel.

When it is desired to release the braking pressure from the railcar wheel, the supply of pressurized hydraulic fluid to the piston-cylinder 52 is decreased, which in turn allows the weight of the upper lever 30 and the return spring 31 to push the piston rod 60 back into the cylinder 52 and move the upper and lower levers 30, 32 towards each other. This motion thereby moves the brake shoes 46 apart from each other and out of the closed position, whereby braking pressure is released from either side of the railcar wheel.

Advantageously, the actuator 50, including the piston-cylinder 52 and the spring 54 work together to apply braking pressure to the sides of the railcar wheel, and yet to allow the brake shoes 44 to spread to the width of the wheel and maintain the desired braking pressure on the sides of the wheel. In the example shown, the spring 54 is connected in series with the piston-cylinder 52 so that the spring 54 will absorb most if not all of the brake shoe displacement caused by the wheel moving through the retarder 18. Ideally, the spring 54 will compress as much as is required to allow entry of a 5.8438 to 5.5938 inch thick wheel into the brake shoes 44 when the shoes 44 are closed to a 5-inch width. In this type of system, the spring 54 will be required to deflect 2.845 to 2.004 without the compressive force on the side of the railcar wheel exceeding the force required to cause wheel lift. If it is not possible to do this while at the same time being able to compress the spring from 0 lbs. to 20,000 lbf. within the space between the upper and lower lever 30, 32, the spring 54 will absorb as much of the displacement as possible, allowing for a fast-acting relief valve (not shown) to vent hydraulic fluid, thus keeping the pressure between the brake shoes 44 and the wheel below the force required to cause wheel lift.

The retarder 18 can operate under pressure for different weight classes, including an OPEN class. Further examples of weight classes are provided below.

LIGHT 262-394 psi
MEDIUM 657-788 psi
HEAVY 1051-1182 psi
X HEAVY 1445-1576 psi

The retarder 18 will also be able to move between any weight class other than the fully opened position in less than 0.5 seconds (e.g. LIGHT to MEDIUM or LIGHT to EXTRA HEAVY in 0.5 seconds). However, if the cylinders collapse to allow a true open condition, it will take approximately 15 seconds (10 gpm pump on a 10 horsepower motor) to refill the piston cylinder 52 to obtain a LIGHT weight class. This issue can be addressed by never truly opening the retarder 18. Instead, the retarder 18 can go to a 60 psi state. The brake shoes 44 will still be closed, piston-cylinders 52 extended. However, there will be little pressure on the wheel (similar to the release of an automobile caliper brake). As long as the 2.569 gallons (0.18 gallons per cylinder for a 4-inch diameter cylinder stroking 3.375 inches) of oil is not drained from the 14 cylinders, the unit will be able to respond to a weight class call in less than 0.5 seconds. A true OPEN weight class could be added for retarder maintenance and trim operations. Adding such a weight class would effect seamless integration with the yard process control system.

It is possible to shorten the time for transitioning from a full OPEN state to a CLOSED state by reducing the travel of the brake shoe. On a standard pneumatic retarder, the brake shoes move from a 6-inch open position to a 5-inch closed position to clamp on a wheel that is 5.7188 plus or minus 0.125 inches (5.8438/5.5938) thick. Reducing the travel from 6-inch open to a dimension greater than 5 inches will reduce cylinder stroke and the time required to move from a true OPEN position to a CLOSED position.

What is claimed is:

1. A retarder for controlling the speed of a railcar, the retarder comprising:

first and second levers that are both pivotable about a common axis between an open position and a closed position, wherein the first and second levers each have a first end and a second end, wherein the first and second levers are oriented with respect to each other so that the respective second ends of the first and second levers oppose each other and define a space there between for receiving a wheel of the railcar;

brakes disposed on the second ends of the first and second levers for engaging and braking the wheel of the railcar; and a hydraulic piston-cylinder and a spring coupled together and disposed between the first ends of the first and second levers;

a first bracket disposed between the piston-cylinder and the spring;

wherein the piston-cylinder has a first end that faces a first side of the first bracket and a second, opposite end that faces the first end of the first lever;

wherein the spring has a first end that faces a second, opposite side of the first bracket and second end that faces the first end of the second lever;

wherein supplying pressurized hydraulic fluid to the piston-cylinder causes the piston-cylinder and the spring to move the brake towards a closed position in which the brake will apply braking pressure on the wheel of the railcar and wherein the spring resiliently biases the brake into the closed position to maintain a substantially constant braking pressure on the wheel as it moves through the retarder.

2. The retarder according to claim 1, wherein the piston-cylinder comprises a rod that is coupled to the first end of the first lever.

3. The retarder according to claim 2, wherein the rod is coupled to the first end of the first lever by a clevis connection.

4. The retarder according to claim 1, wherein the bracket comprises outwardly extending flanges, and wherein the first end of the spring abuts the outwardly extending flanges.

5. The retarder according to claim 1, comprising a second bracket disposed between the spring and the first end of the second lever, wherein the second end of the spring abuts the second bracket.

6. The retarder according to claim 1, wherein the spring is wrapped around a cylinder of the piston-cylinder.

* * * * *